US007896684B2

(12) United States Patent
Guillanton

(10) Patent No.: US 7,896,684 B2
(45) Date of Patent: Mar. 1, 2011

(54) CONNECTOR ASSEMBLY

(75) Inventor: Erwan Guillanton, Maintenon (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/309,123

(22) PCT Filed: Jul. 13, 2006

(86) PCT No.: PCT/IB2006/003457

§ 371 (c)(1),
(2), (4) Date: May 18, 2009

(87) PCT Pub. No.: WO2008/010018

PCT Pub. Date: Jan. 24, 2008

(65) Prior Publication Data

US 2010/0035460 A1 Feb. 11, 2010

(51) Int. Cl.
*H01R 13/64* (2006.01)

(52) U.S. Cl. ..... 439/374

(58) Field of Classification Search ..... 439/374, 439/372, 157, 293, 701, 686, 247, 557
See application file for complete search history.

(56) References Cited

U.S. PATENT DOCUMENTS 5,931,688 A * 8/1999 Hasz et al. ..... 439/247
6,045,410 A * 4/2000 Norizuki et al. ..... 439/701
6,786,747 B1 * 9/2004 Kamath ..... 439/188
7,077,696 B2 * 7/2006 Haga et al. ..... 439/553
2009/0209124 A1 * 8/2009 Klein ..... 439/342

FOREIGN PATENT DOCUMENTS

DE 26 38 187 A1 3/1978
EP 1 662 618 A1 11/2005

* cited by examiner

*Primary Examiner*—Alexander Gilman
(74) *Attorney, Agent, or Firm*—Harrington & Smith

(57) ABSTRACT

The invention proposes a connecting assembly including a frame, a contact receptacle (hereafter 'receptacle') of an electrical connector and a contact header (hereafter 'header') of a counterpart electrical connector to be plugged into the electrical connector according to a plugging direction, wherein it is arranged such that the header and the receptacle can be both independently pushed into the plugging direction with respect to the frame, and wherein it further includes: first stopping means arranged for stopping the header on the receptacle if the header is pushed according to the plugging direction with a force that is lower than to a first force limit F2, and for being gone beyond if said force is greater than F2 such that the header and the receptacle are then connected together; second stopping means arranged for stopping the receptacle on the frame if the receptacle is pushed according to the plugging direction with a force that is lower than a second force limit F3, and for being gone beyond if said second force is greater than F3 such that the receptacle is then mounted to the frame; wherein F3 is greater than F2.

41 Claims, 7 Drawing Sheets

CONNECTOR ASSEMBLY

FIELD OF THE INVENTION

The present invention generally relates to the field of the electrical connectors, and particularly to a method for connecting on a frame an electrical contact receptacle of an electrical connector and a contact header of a homologous electrical connector, and a connecting system arranged for operating this method.

BACKGROUND OF THE INVENTION

From the state of the art, this method has been used for connecting a device into a support structure, and particularly to install an electronic device (e.g. a radio, a CD reader or a GPS component) into the housing of a vehicle for connecting it to an electrical wiring network of the vehicle.

FIG. 1 shows an exploded view of a connecting system arranged for implementing this method. This connecting system comprises on the one hand said electrical or electronic device 8 and on the other hand a support structure 9 lodged in the housing (the latter being not shown).

The support structure 9 is designed for receiving the device 8 and for connecting it to an external electrical network 30. Especially, it comprises a dashboard 15 defining an entrance 16 for the introduction of the device 8 into the support structure 9. The support structure 9 further comprises lateral guiding girders 14 extending from the back of the dashboard 15, along the length of the housing, that are designed for guiding the device 8 into the support structure (when the user pushes the device) until the bottom part of the support structure 9. This bottom part is constituted by a frame 13 fixed at the ends of the girders 14. The frame 13 comprises a connector receptacle 12 able to receive on one side an external electrical network 30 of the vehicle and on the other side the pin header 21 provided at the back side of the device 8. When the device is entirely housed in the support structure 9, the pins of the header 21 are then connected to the external electrical network 30. Optionally, fixing means are provided for fixing the front part of the device 8 to the dashboard 15.

Thus, both the housing of the device 8 in the support structure 9 of the vehicle and the connection of this device to the external electrical network 30 of the vehicle are ensured by simply pushing the device 8 along the plugging direction (the X-axis in FIG. 1).

Now, the dimensions of the housing can vary according to the type of the vehicle.

Additionally, the dimensions of the devices can vary from a manufacturer to another one.

Then, it would be desirable to have a connector assembly that can accept a certain tolerance in the dimension of the housing and/or of the device.

It is known to find this kind of tolerance in the (YZ) plane by allowing a slight floating and/or rotation of the guiding girders with respect to the bottom frame.

Regarding the X-axis tolerance, it is known to add a spring whose compression ensures the force required for connecting the pin headers to the wiring harness. As the connector has to accommodate certain tolerances in the X-axis, the compression rate of the spring is chosen more or less high, depending on these tolerances.

A disadvantage of this connector assembly is that the spring force has always to be greater than the connexion force. The effort supplied by the operator is therefore equal to the connexion force plus an important margin that takes account of the tolerances. The assembly is further difficult to do because the connexion effort has to be maintained until the installation is completed. The conjunction of the spring with the mass of the connector might further create vibrations.

In view of the foregoing it is an object of the present invention to provide an improved connector assembly able to compensate for positional tolerances, and especially for compensated tolerance in the X-axis.

SUMMARY OF THE INVENTION

According to a first aspect of this invention therefore a connecting assembly comprising a frame, a contact receptacle (hereafter "receptacle") of an electrical connector and a contact header (hereafter "header") of a counterpart electrical connector to be plugged into the electrical connector according to a plugging direction, wherein it is arranged such that the header and the receptacle can be both independently pushed into the plugging direction with respect to the frame, and wherein it further comprises:

first stopping means arranged for stopping the header on the receptacle if the header is pushed according to the plugging direction with a force that is lower than a first force limit F2, and for being gone beyond if said force is greater than F2 such that the header and the receptacle are then connected together;

second stopping means arranged for stopping the receptacle on the frame if the receptacle is pushed according to the plugging direction with a force that is lower than a second force limit F3, and for being gone beyond if said second force is greater than F3 such that the receptacle is then mounted to the frame;

wherein F3 is greater than F2

Optional characteristics of this connecting assembly are:

the frame comprises guiding means for holding and guiding the receptacle according to the plugging direction;

said guiding means are arranged for leaving to the receptacle a degree of freedom along the plugging axis with respect to the frame, once the header is connected to the receptacle and once the receptacle is mounted to the frame;

it is further arranged for having a degree of freedom of the header in a plane perpendicular to the plugging axis, with respect to the frame;

said first stopping means comprises a first ramp borne by the header and a second ramp borne by the receptacle, the first and second ramps being able to slide to each other, the first and second ramps are arranged for being in contact to each other if the header and the receptacle are in a determined distance from each other, and the first ramp is stopped at the second ramp if said first force is lower than F2 and goes beyond said second ramp if said first force is greater than F2;

said second stopping means comprises a stop wall perpendicular to the plugging axis borne by the receptacle and a third ramp borne by the frame, the stop wall being able to slide onto the third ramp, the stop wall and the third ramp are arranged for being in contact to each other if the receptacle and the frame are at a determined distance from each other, and the stop wall is stopped at the third ramp if said second force is lower than F3 and goes beyond said third ramp if said second force is greater than F3;

it further comprises:

third stopping means arranged for stopping the receptacle to the frame if the receptacle is pushed according to the plugging direction, the third stopping means being located with respect to the second stopping means such that the third stopping means is used before the second stopping means as the receptacle is pushed according to the plugging direction from a remote position;

means for releasing the third stopping means if the header is pushed according to the plugging direction with a third force that is greater than a third force limit F1, such that the receptacle goes beyond the third stopping means;

said third stopping means comprises a stop wall perpendicular to the plugging axis and provided on a deflectable tongue extending from the frame according to a direction opposite to the plugging direction, and a stop wall perpendicular to the plugging axis and borne by the receptacle, these stop walls are arranged for being in contact to each other if the receptacle and the frame are at a determined distance from each other, and the header comprises means for deflecting the tongue according to a direction perpendicular to the plugging axis such that the tongue is sufficiently deflected from its initial position for removing the abutment between said two stop walls if the header is pushed according to the plugging direction with a force greater than F1; the receptacle, if pushed according to the plugging direction, going then beyond the stop wall of the tongue of the frame until being stopped at the second stopping means;

the means of the header for deflecting the tongue of the frame comprises a first rigid tab having a front ramp, and the tongue comprises a second rigid tab extending perpendicular to the plugging axis from a side of the tongue and having a front ramp, the header and the frame are arranged such that said ramps are in contact to each other if the header and the frame are at a determined distance from each other and the front ramps of the tabs being able to slide onto the other such that a deflection of the tongue is involved by said sliding if the header is pushed according to the plugging direction;

the stop wall borne by the frame tongue is the end of the frame tongue;

the header, the receptacle and the frame are arranged such that the means of the header for deflecting the tongue is used after the header is stopped by the first stopping means if the header is pushed according to the plugging direction, and F2 is greater than F1;

it further comprises fourth stopping means arranged for stopping the receptacle on the frame, once the receptacle is mounted to the frame, if the receptacle is pulled opposite to the plugging direction; the receptacle being then locked onto the frame;

the fourth stopping means comprises a fourth ramp borne by the receptacle and a fifth ramp borne by the frame, the fourth and fifth ramps being able to slide to each other, the fourth and fifth ramps are arranged for being in contact to each other if the receptacle is mounted onto the frame and if the receptacle and the frame are at a determined distance from each other, and the fourth ramp is stopped at the fifth ramp if said fourth force is lower than F4 and goes beyond said fifth ramp if said fourth force is greater than F4;

the fifth ramp has a sloping angle with respect to the plugging axis that is smaller than the sloping angle of the third ramp;

it further comprises fifth stopping means arranged for preventing the header to be disconnected from the receptacle once the first stopping means has been gone beyond, if the header is pulled opposite to the plugging direction; the header being then locked onto the receptacle;

the fifth stopping means comprises:

a stop wall provided on the receptacle and extending perpendicular to the plugging axis;

a stop wall provided on the header and extending perpendicular to the plugging axis;

and the respective positions of these two stop walls are chosen for allowing them to face each other if the header is connected to the receptacle and if the header is pulled opposite to the plugging direction;

it further comprises means for releasing the fifth stopping means if the header connected to the receptacle is pulled opposite to the plugging direction, with a fifth force that is greater than a fifth force limit F5, such that the header goes beyond the fifth stopping means for being then disconnected from the receptacle;

the stop wall provided on the header is on a deflectable tongue extending to the plugging direction from the header, and the means for releasing the fifth stopping means comprises means for deflecting the tongue according to a direction perpendicular to the plugging direction such that the tongue is sufficiently deflected from its initial position for having its stop wall upper than the apex of the stop wall provided on the receptacle, if the header is pulled opposite to the plugging direction with a force greater than F5; the header, if pulled opposite to the plugging direction, going then beyond the stop wall of the receptacle; the header and the receptacle being then disconnected to each other;

the means for deflecting the tongue of the header comprises a third rigid tab extending perpendicular to the plugging axis and having a rear ramp provided on the frame, and the tongue of the header comprises a fourth rigid tab having a rear ramp and extending perpendicular to the plugging axis from a side of the tongue, the rear ramps of the tabs being able to slide onto the other such that a deflection of the header tongue is involved by said sliding if the header is pulled opposite to the plugging direction, the header and the frame are arranged such that said ramps are in contact to each other if the header and the frame are at a determined distance from each other;

the second rigid tab extending from a side of the tongue of the frame and the third rigid tab extending from a side of the tongue of the header, and the first and fourth rigid tabs of the header are a single tab and the second and third tabs of the frame are a single tab;

the header is intended to be fixed to the back side of an electrical or electronic device, and the assembly comprises means for guiding this device according to the plugging axis;

it is designed for being housed in an external cavity and for housing the device and connecting the latter to an external electrical network via said connectors.

A second aspect of the invention proposes a method for connecting on a frame a contact receptacle (hereafter "receptacle") of an electrical connector and a contact header (hereafter "header") of a counterpart electrical connector to be plugged into the electrical connector according to a plugging direction, characterized in that the receptacle and the header are both mobile towards the plugging direction with respect to the frame, in that the method comprises the following steps:

(a) mounting the receptacle on the frame at an intermediate position;

(b) locking the header to the receptacle such that the electrical connector and the counterpart electrical connector are plugged together;

(c) locking the receptacle on the frame at a final position;

and in that these different steps are implemented by exerting an effort on the header according to the plugging direction.

Optional characteristic of this connecting method is:

the force necessary for implementing successively the steps (a), (b) and (c) respectively increases.

A third aspect of this invention is to propose a method for disconnecting from a frame a contact receptacle (hereafter "receptacle") of an electrical connector and a contact header (hereafter "header") of a counterpart electrical connector having been plugged to the electrical connector according to a plugging direction, characterized in that the receptacle and the header are both able to be mobile in a direction opposite to the plugging direction with respect to the frame, in that the method comprises the following steps:

(a) dismounting the receptacle connected to the header from the frame;

(b) dismounting the header from the receptacle so as to disconnect the electrical connector and the counterpart electrical connector, the header having then no contact with both the receptacle and the frame;

and in that these different steps are implemented by exerting a force on the header opposite to the plugging direction.

A fourth aspect of this invention is to propose a connector assembly for receiving and connecting an electrical device to an external electrical network according to a plugging axis, comprising:

a housing for housing the electrical device, comprising:

a front aperture for engaging the electrical device into the housing along the plugging axis;

lateral guiding means for guiding the electrical device from the front aperture to a rear part of the housing according to the plugging axis;

a fixed frame at a rear part of the housing structure, comprising second guiding means according to the plugging axis;

an electrical connector for receiving the external electrical network from a rear side and a counterpart electrical connector on a front side, the electrical connector being mounted to said second guiding means, being then mobile along the plugging axis, wherein the electrical connector comprising a contact receptacle (hereafter called "receptacle");

a counterpart electrical connector for being plugged into the electrical connector according to the plugging axis, the counterpart electrical connector being further intended to be mounted at a back side of said electrical device and electrically connected to the latter, wherein it comprises a contact header (hereafter "header") arranged for cooperating with said receptacle for allowing said plug;

first stopping means arranged for stopping the header on the receptacle if the header is pushed in the housing according to the plugging axis with a force that is lower than a first force limit F2, and for being gone beyond if said force is greater than F2 such that the header is then locked to the receptacle and that said connectors are plugged together;

second stopping means arranged for stopping the receptacle to the frame if the receptacle is pushed in the housing according to the plugging axis with a force that is lower than a second force limit F3, and for being gone beyond if said second force is greater than F3 such that the receptacle is then mounted to the frame;

wherein F3 is greater than F2.

Optional characteristics of this connector assembly are:

said second guiding means are arranged for leaving to the receptacle a degree of freedom along the plugging axis with respect to the frame once the header is connected to the receptacle and once the receptacle is mounted to the frame;

the lateral guiding means are mounted to the frame such that it can be slightly moved in a plane perpendicular to the plugging axis, with respect to the frame;

the header comprises a first tongue extending according to the plugging axis and deflectable according to an axis perpendicular to the plugging axis, the first tongue comprising a front ramp at its end part, and the receptacle comprises a first shoulder with a front ramp, the front ramps being able to slide to each other if the header and the receptacle are moved towards each other and if the header and the receptacle are at a determined distance from each other, these ramps being said first stopping means;

the first tongue further comprises a back stop wall behind the front ramp and perpendicular to the plugging axis, and the first shoulder of the receptacle comprises a back stop wall perpendicular to the plugging axis, such that, when the front ramps have slid to each other if the header and the receptacle are moved towards each other, the two back stop walls can be in contact to each other, locking the header to the receptacle;

the frame comprises a second tongue extending according to the plugging axis and deflectable according to an axis perpendicular to the plugging axis, the second tongue comprising a shoulder with a front ramp, and the receptacle comprises a second shoulder with a back stop wall perpendicular to the plugging axis, the front ramp of the second tongue and the back stop wall of the second shoulder being able to slide to each other if the receptacle is pushed towards the frame and if the frame and the receptacle are at a determined distance from each other, these front ramp and back stop wall being said second stopping means;

the shoulder of the second tongue further comprises a rear ramp, and the second shoulder of the receptacle further comprises a front ramp, such that, when the back stop wall of the first shoulder have slid to the front ramp of the second tongue if the receptacle is moved towards the frame, the front ramp of the first shoulder can be in contact with the rear ramp of the second tongue, locking the receptacle to the frame;

the front ramp has a sloping angle greater than the rear ramp of the shoulder of the second tongue;

it further comprises third stopping means arranged for stopping the receptacle to the frame if the receptacle is pushed towards the frame, the third stopping means being located with respect to the second stopping means such that the third stopping means is used before the second stopping means as the receptacle is pushed from a remote position; and the header comprises means for releasing the third stopping means if the header is pushed towards the frame with a third force that is greater than a third force limit F1, such that the receptacle goes beyond the third stopping means;

said third stopping means comprises:

a stop wall perpendicular to the plugging axis and provided on the second deflectable tongue and the back stop wall of the second shoulder, wherein these stop walls are arranged for being in contact to each other if the receptacle and the frame are at a determined distance from each other and if the receptacle is pushed towards the frame, and wherein the first tongue comprises means for deflecting the second tongue according to a direction perpendicular to the plugging axis such that the second tongue is sufficiently deflected from its initial position for releasing the abutment between said two stop walls if the header is pushed towards the frame with a force greater than F1;

the receptacle, if pushed then towards the frame, being able to go beyond the stop wall of the frame until being stopped at the second stopping means;

the means for deflecting the second tongue comprises a first rigid tab, and the second tongue comprises a second rigid tab, the first and second rigid tabs extending perpendicularly to the plugging axis and both having a front ramp, the header and the frame are arranged such that said front ramps are in contact to each other if the header and the frame are at a determined distance from each other, and the front ramps of the tabs being able to slide onto the other such that said deflection of the second tongue is involved by said sliding if the header is pushed towards the frame;

the stop wall of the second tongue is the end of the second tongue;

the header, the receptacle and the frame are arranged such that the means of the first tongue for deflecting the second tongue is used after the header is stopped by the first stopping means if the header is pushed towards the frame, and F2 is greater than F1;

the second tongue comprises means for deflecting the first tongue according to a direction perpendicular to the plugging axis in order to release the abutment between the back stop wall of the first tongue and the back stop wall of the first shoulder of the receptacle, this abutment being found when the header is connected to the receptacle and if the header is pulled opposite to the receptacle;

the first tongue comprises a first rigid tab, and the means for deflecting the first tongue comprises a second rigid tab, the first and second rigid tabs extending perpendicularly to the plugging axis and both having a rear ramp, the header and the frame are arranged such that said rear ramps are in contact to each other if the header and the frame are at a determined distance from each other, and the rear ramps of the tabs being able to slide onto the other such that said deflection of the first tongue is involved by said sliding if the header is pulled outwards the frame said first rigid tabs of the second tongue are a single rigid tab, and said second rigid tabs of the first tongue are a single rigid tab.

Other characteristics, objects, and advantages of the invention will appear in the following detailed description, which is not limitative illustrated with the following figures.

DETAILED DESCRIPTION OF THE INVENTION

Figure 1:
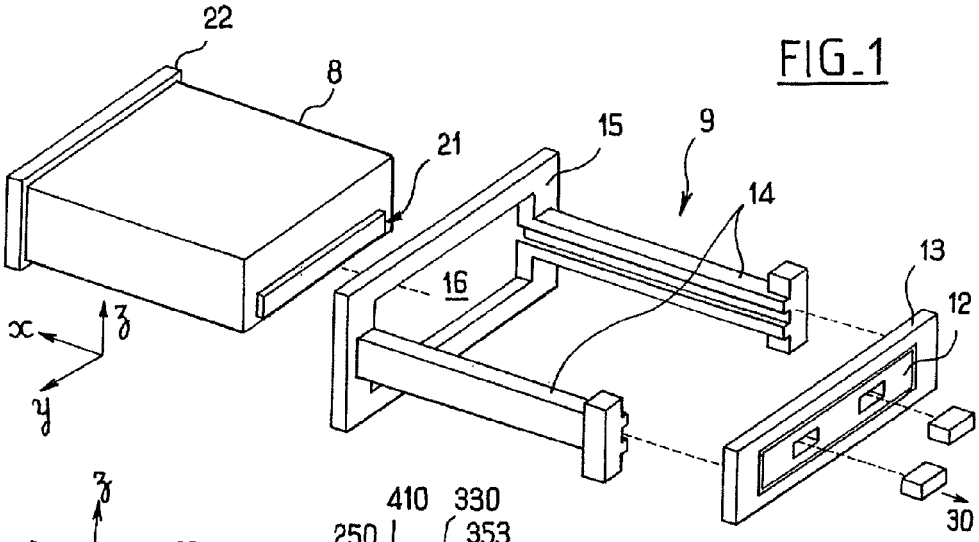
FIG. 1 shows an exploded view of a connector system according to the prior art.
Figure 2:
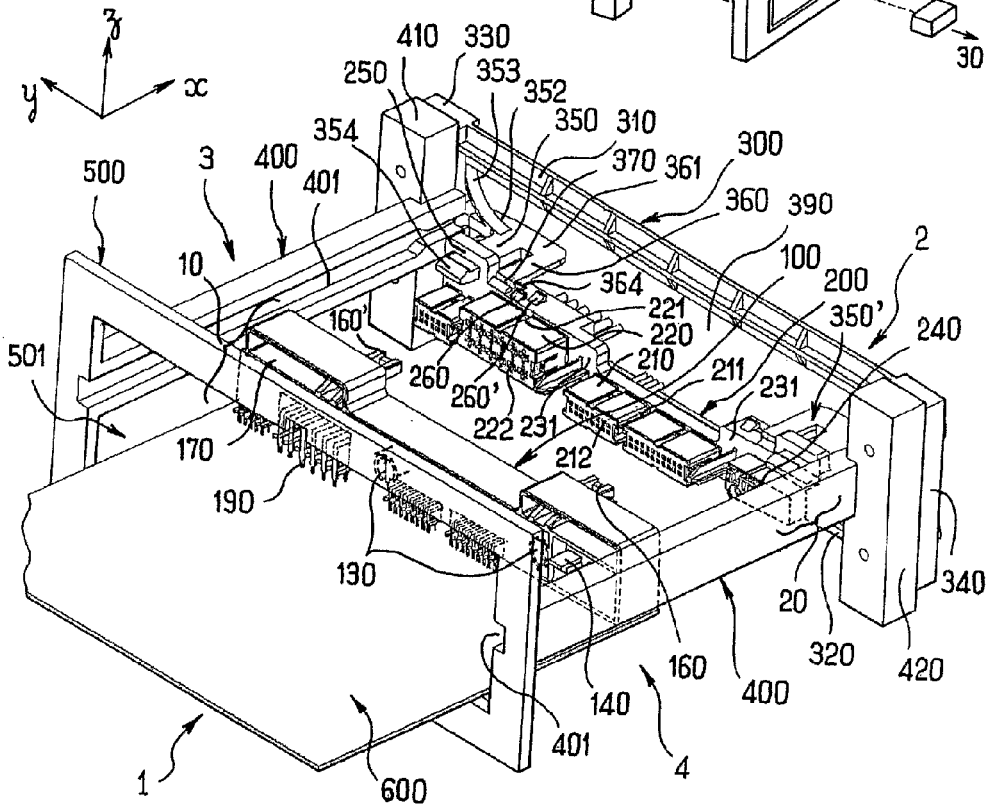
FIG. 2 shows a perspective view of a connector system according to the invention.
Figure 3:
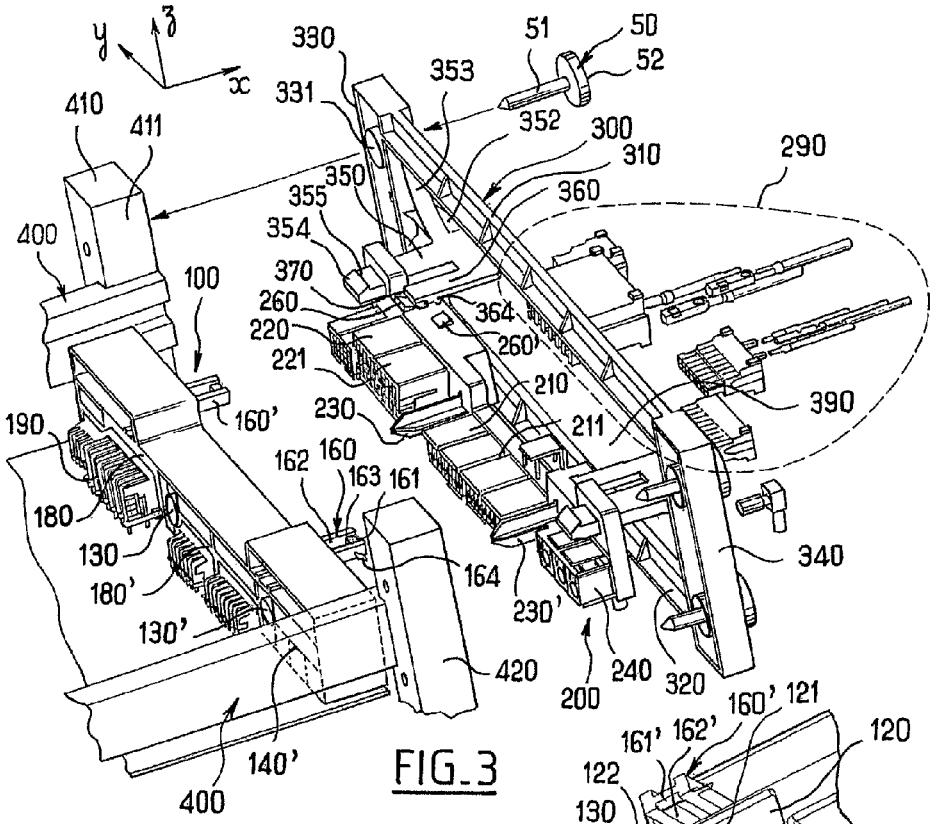
FIG. 3 shows an exploded view of a part of a connector system according to the invention.

FIGS. 2 and 3 show respectively a general and particular views of a connector system according to the invention.

This connector system comprises mainly the two following parts:

the electrical or electronic device (represented in the FIG. 2 by its printed circuit board 600) provided with an electrical connector 10 at its back side;

a support structure designed for receiving the device and for connecting it to an external electrical network; it comprises a counterpart electrical connector 20 for receiving the electrical connector 10 and connecting it to the external electrical network.

The support structure has a general parallelepipedic shape and comprises:

a front part 1 comprising an aperture 501 having a dimension equal or greater than the largest cross-section of the electrical device; the aperture 501 is typically defined by a dashboard 500;

a rear part 2 comprising a frame 300 and said counterpart electrical connector 20. The counterpart electrical connector 20 comprises a contact receptacle 200 (hereafter called "receptacle") and electrical terminal elements 290 intended to receive the terminal parts of the external electrical network.

The receptacle 200 is designed for receiving from its rear side said terminal elements 290 of the external electrical network and for receiving on its front side said electrical connector 10 provided at the back side of the device, ensuring then the connection between the device and the external network;

lateral guiding means 401, included for instance in girders or rods 400, which define the sides of the support structure, extending between the lateral portions of the front part 1 and of the rear part 2 of the support structure.

The support structure defines then an external volume that is approximately the same as those of the housing intended to receive it. This housing (not shown in FIGS. 2 and 3) can be provided by example inside a front panel of a motor vehicle or in another system.

The support structure defines also an internal volume that is approximately the volume of the electrical device to be engaged within.

It is to be noticed that, in the following description of the invention:

the direction of reference will be the plugging direction, which is pointed from the front part 1 of the support structure towards the rear part 2 of the support structure (along the X-axis);

the front sides of electrical connectors or of parts of them (i.e. receptacle 200 and header 100) are the sides from which they receive the counterpart connector;

Said electrical device is provided with an electrical connector 10 at its back side. This electrical connector comprises electrical support elements 190 connected to the circuit board 600 and a contact header 100 (hereafter called "header") for making easier the connexion with said receptacle 200.

Figure 4:
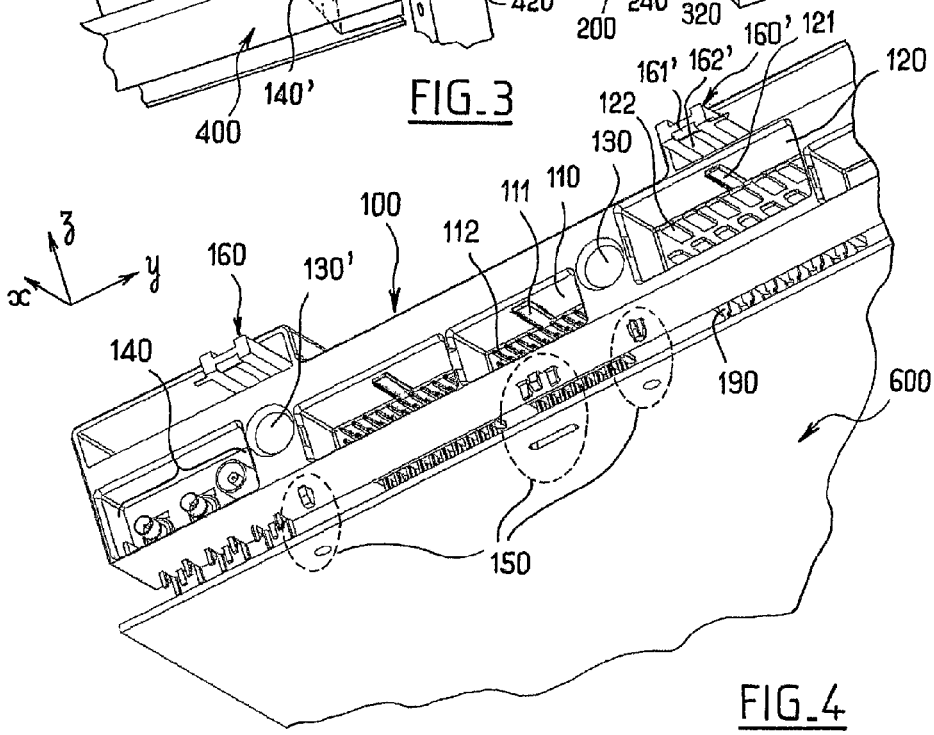
FIG. 4 shows a perspective view of a part of an electrical connector and of a circuit board of an electrical device, and means for fixing the connector to the circuit board.
Figure 5:
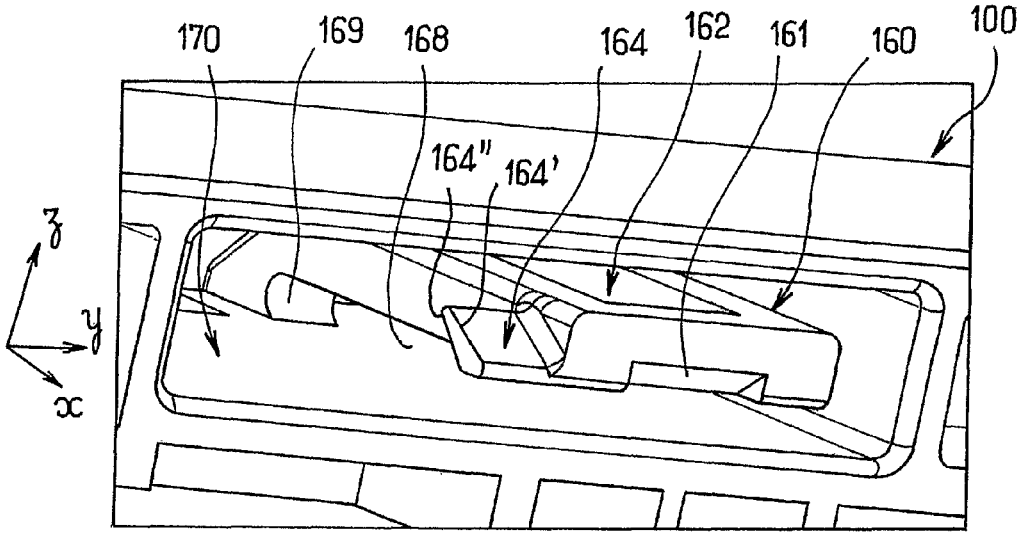
FIGS. 5 and 6 show perspective views of a part of, respectively, the front side and the rear side of the electrical connector.
Figure 6:
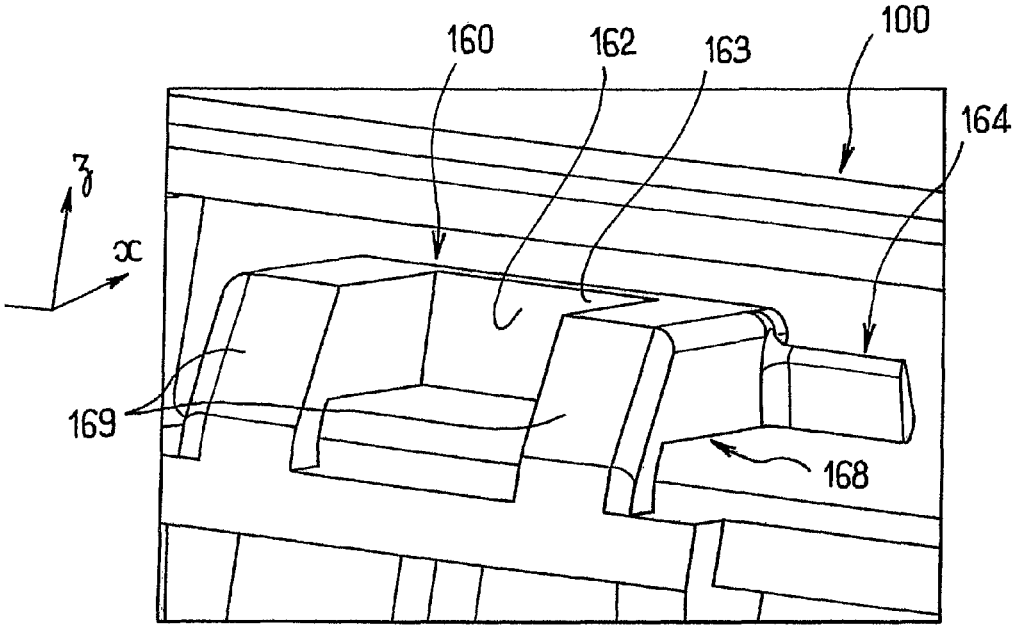

The header 100 can be clipped onto the rear part of the circuit board thanks to clipping means 150 (see FIG. 4).

The header 100 has typically a parallelepipedic shape.

The header 100 is typically made of an electrical insulator material, like a rigid plastic.

The header 100 comprises one or more internal casings 180-180' for housing the terminals of said electrical support elements 190.

The rear side of the header 100 comprises one opening by casing so as to allow the engagement of the electrical support elements 190 in the casings 180-180'. The electrical support elements 190 shown in FIG. 3 may be some elbowed pins, some wiring harness (housed or not in plastic boxes) that are to be connected, at their other ends, to the circuit board 600 of the device. Additionally, a further opening 140 may be provided at the rear side of the header 100 for receiving the electrical current feeding coming from the external electrical network.

With reference to FIG. 4, at the front face of the header 100, some connecting elements 112-122 are provided (such as male elements, like pins, or female elements, like grids) at each said casing 180-180', electrically coupled to the rear electrical support elements 190.

Preferably, as shown in FIG. 4, the connecting elements 112-122 are located at the bottom of cavities 110-120 provided on the front face of the header 100. These cavities 110-120 are designed for receiving complementary protruding elements 210-220 of the receptacle 200.

According to the invention, the header 100 comprises two deflectable tongues 160-160' (hereafter called "header tongue") parallel to the X-axis.

In a first embodiment according to the invention (see FIGS. 2, 3 and 4), these header tongues 160-160' extend from the front side of the header 100. They are hold by a rear part housed in a housing 170.

In a second embodiment according to the invention (see FIGS. 5, 6, 7 and 8), each header tongue 160 is housed in a cavity 170 parallel to the X-axis and provided inside the header 100. Each cavity 170 has to be designed for further receiving a frame tongue 360 (discussed later). Each header tongue 160 is hold by its back side 160, in order to leave a free space 168 under the header tongue 160 for engaging a rear shoulder 260' of the receptacle 200 within (discussed later).

The end of each header tongue 160 is provided with a front sloping ramp 161 (hereafter called "header ramp") which extends from the end of the header tongue 160 outwardly with respect to the rear side 2 of the support structure. The header ramp 161 allows an external element, coming from the rear side 2 of the support structure according to the X-axis to slide on the header ramp 161.

Additionally, at least a portion of the bottom surface of each header tongue 260 that is located behind the header ramp 161 present a cavity 162 or a hole for housing an external element that had slid on and gone beyond the header ramp 161. Behind the header ramp 161, the cavity 162 defines a back stop wall 163 (hereafter called "header back stop wall") that is perpendicular to the (XY) plane. Then, once an external element coming from the rear side 2 of the support structure had been slid on and gone beyond the header ramp 161, it will be stopped by this header back stop wall 162 if it is moved then to the opposite direction.

Figure 10A:
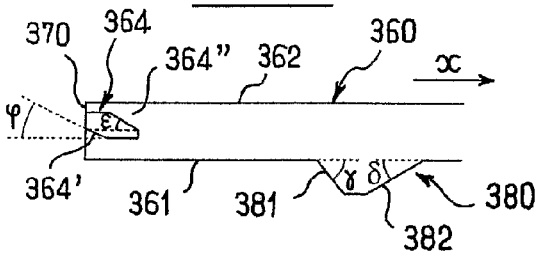
FIGS. 10A and 10B show respectively side and front views of elements of the frame.
Figure 10B:
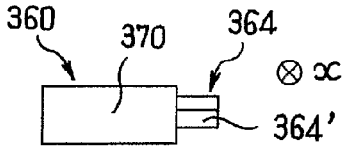

Furthermore, one lateral side of each header tongue 260 is provided with a rigid tab 164 (hereafter called "header tab") extending from this side according to a direction parallel to Y-axis. The cross-section of each header tab 164 is designed for having a rear ramp 164" at its bottom surface and a front ramp 164' at its top surface such that an external element can slide on the rear ramp 164" if it comes from the rear side of the header 100 according to the X-axis and can slide on the front ramp 164' if it comes from the front side of the header 100 according to X-axis. Preferably, the angle $\alpha$ of the front ramp 164' is smaller than the angle $\beta$ of the rear ramp 164", with respect to the X-axis (see FIGS. 10U and 10B).

Furthermore, the length of each header tongue 160 is chosen so that its header ramp 161 overlaps a part of the receptacle 200 when the electrical connection between the different electrical elements of the header 100 and of the receptacle 200 is operated or close to be operated. Additionally, the configuration of each header tongue 160 is chosen so that it can be deflected along the Z-axis if an external elements slide on the header ramp 161, on the rear ramp 164" of the header tab 164 or on the front ramp 164' of the header tab 164.

Furthermore, the front side of the header 100 is provided with two transversal channels 130-130' extending parallel the X-axis for receiving corresponding two counterpart centring fingers 230-230' provided on the front side of the receptacle 200 (as seen later).

The frame 300 of the support structure is intended to be placed at the bottom side of the housing provided in the vehicle. Typically, this frame 300 is fixed to the housing or to the vehicle, and represents then the non-mobile part of the support structure. Additionally, the frame 300 is configured and made of materials for being static and rigid when forces used for the mating of the device or for the dismounting are exerted on it. The frame 300 can be made of plastic or metal.

It is to be noted that the front side of the frame 300 will be considered in the following as the side facing the front part 1 of the support structure.

From FIG. 2, 3, 7 or 8, the frame 300 has a general rectangular shape in a (YZ) plane, defined by two vertical columns 330-340 and two transversal girders 310-320, leaving then a large central opening 390 through which electrical terminal elements 290 of the external electrical network may be introduced for being housed into the receptacle 200.

From the interior side of each column, a L-shaped element extends in the (XY) plane such that one of the two legs 352 of the L is fixed to the associated column 330, and the other leg 350 of the L extends inwardly the support structure parallel to the X-axis, the second leg 350 forming then an inner protrusion 350. Eventually, some reinforcements 353 are provided for rigidifying the L-shaped elements with the interior surface of the columns 330-340.

Each protrusion 350 has substantially the same cross-section all along its length. It is designed for receiving a corresponding part of the receptacle 200 and for guiding the latter along its length (according to a direction parallel the X-axis). Optionally, the end parts 354 of these protrusions 350 are chamfered or bevelled for guiding the montage of the receptacle 200 thereon. Optionally, the ends of the protrusions 350 are provided with stop walls 355 facing the rear part 2 of the support structure, for preventing the receptacle 200 for being dismounted from the frame 300. The protrusions 350 are configured and made for being static and rigid when the receptacle 200 is supported thereon, even if forces are exerted on the frame 300.

Furthermore, two second L-shaped elements extend in the same manner from the respective columns 330-340. Optionally, a first leg 361 of each second L-shaped element, which is fixed to the associated column 330, has a common portion with the first leg 352 of the corresponding first L-shaped element. The second leg 360 of each second L-shaped element extends inwardly the support structure and is parallel to the X-axis. This second leg 360 constitutes a deflectable tongue (hereafter called "frame tongue").

The end surface 370 of the frame tongue 360 is preferably perpendicular to the X-axis.

Figure 11A:
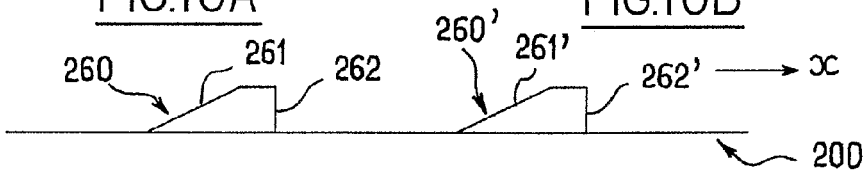
FIGS. 11A and 11B show respectively side and front views of elements of the contact receptacle.
Figure 11B:
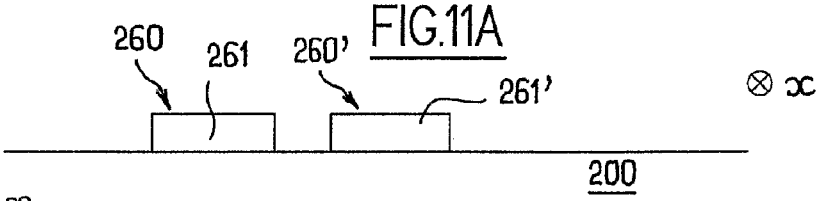

With reference to FIGS. 11A and 11B, the bottom surface 361 of the frame tongue 360 is provided, at a determined distance from its end 370, with a shoulder 380 that presents a front ramp 381 and a rear ramp 382. The front ramp 381 faces the front part 1 of the support structure and allows then an external element coming from the front part 1 of the support structure to slide thereon. The rear ramp 382 faces the rear part 2 of the support structure and allows then an external element coming from the rear part 2 of the support structure to slide thereon. With respect to the bottom surface 361 of the frame tongue 360, the angle $\gamma$ of the front ramp 381 is preferably greater than the angle $\delta$ of the rear ramp 382.

Additionally, a rigid tab 364 (hereafter called "frame tab 364") extends transversally to and from a side of each frame tongue 360. The cross-section of each frame tab 364 is chosen for presenting at a bottom side a front ramp 364', and at a top surface a rear ramp 364", such that an external element can slide on the front ramp 364' if it comes from the front part 1 of the support structure and can slide on the rear ramp 364" if it comes from the rear part 2 of the support structure. Advantageously, the slope $\epsilon$ of the front ramp 364' is greater than the slope $\phi$ of the rear ramp 364" of the frame tab 364, with respect to a (XY) plane.

Moreover, the frame tongue 360 is configured and made of materials such that it can be deflected along the Z-axis under a sliding force exerted on one of the ramps 381-382 of said frame shoulder 380 or on one of the ramps 364'-364" of the frame tab 364.

Figure 12A:
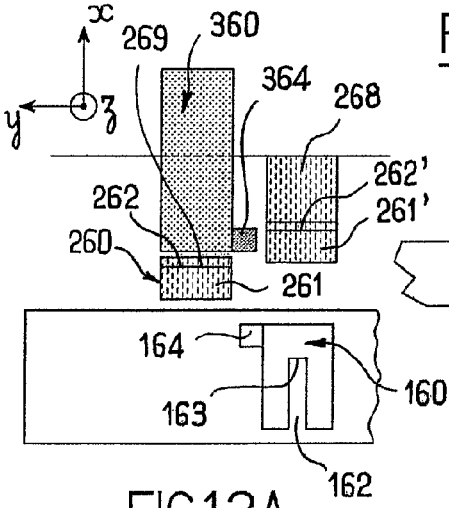
FIGS. 12A and 12B show respectively top and side views of the location of said elements according to FIGS. 9-11, in a connecting system according to the invention.

Moreover, from FIG. 12A, the positions and dimensions of the frame tongue 360 and of the header tongue 260 are chosen such that the frame tab 364 and the header tab 164 come into contact together, when the header 100 and the frame 300 are separated by a determined distance.

Especially, the respective front ramps 364'-164' of the frame tab 364 and of the header 164 are designed for being able to be slid one onto the other if the header 100 is at said determined distance from the frame 300 and if it is moved according to the plugging direction, and the respective rear ramps 364"-164" of the frame tab 364 and of the header tab 164 are made for being slidable one onto the other when the header 100 moves opposite to the plugging direction.

The receptacle 200 has preferably a parallelepipedic shape. It comprises at least one internal casing for receiving electrical terminals elements 290 of the external electrical network, the latter being linked to the ends (see FIG. 3).

The receptacle 200 may be made of an electrical insulator material like a rigid plastic.

The receptacle 200 has one rear opening by casing for receiving the terminal elements 290 of the external electrical network (some examples of terminal elements that can be received in the casings through the rear opening of the receptacle 200 are depicted in FIG. 3).

The front side of the receptacle 200 comprises front connecting elements 212-222 (female elements, like a grid, or male elements, like pins) for receiving the counterpart connecting elements 112-122 (respectively male elements or female elements) of the front side of the header 100.

As shown in FIGS. 2, 3, 7 and 8, the shape of the front side of the receptacle 200 may be designed such that the connecting elements 211-221 are located on front faces of some protruding elements 210-220 that can be fitted into said corresponding cavities 110-120 provided at the front side of the header 100. This configuration allows the respective connecting elements to be guided to each other just before the connection. Additionally, some grooves 211-221, parallel to X-axis, can be provided on sides of the protruding elements 210-220 and complementary ribs 111-121, parallel to X-axis, can be provided on sides of the cavities 110-120, for improving the guiding of the connexion when they cooperate to each other. This configuration then helps for a better connection.

Advantageously, between each connector casing, the receptacle 200 comprises flat panels 231 that preferably extend in one (YZ) plane.

From two of these flat panels 231, two respective centring fingers 230-230' extend according to directions parallel to the X-axis, towards the front part 1 of the support structure. The length and positions of these centring fingers 230-230' are chosen such that they can enter into said transversal channels 130-130' provided in the header 100, when the receptacle 200 and the header 100 are sufficiently close to each other. Thus, the centring fingers 230-230' allows a first guiding step during the mating of the header 100 onto the receptacle 200, for operating the connection between the circuit board 600 (i.e. the device) and the external electrical network. Optionally, the end parts of the centring fingers 230-230' are tipped in order to facilitate the engagement of the centring fingers 230-230' into the corresponding transversal channels 130-130', especially useful if a misalignment exists between the header 100 and the receptacle 200.

Furthermore, some lateral flat panels 250 are each provided with a transversal aperture to be engaged by one associated protrusion 350 of the frame 300. The cross-section of each aperture is equal or slightly greater than the cross-section of the associated protrusion 350. Thus, when the receptacle 200 is engaged onto said protrusions 350 of the frame 300 through these apertures, the receptacle 200 is hung on the frame 300. More particularly, the receptacle 200 is movable along the X-axis by sliding along the length of the protrusions 350.

Moreover, with reference to FIGS. 3, 7, 8, 11A and 11B, two portions of the top side of the receptacle 200 are each provided with one front shoulder 260 and one rear shoulder 260'. Each one of these shoulders comprises:

a front ramp 261-261' extending from the receptacle 200 top surface towards the rear part 2 of the support structure; and a back stop wall 262-262' that extends from the receptacle 200 top surface substantially perpendicularly to the X-axis.

Figure 12B:
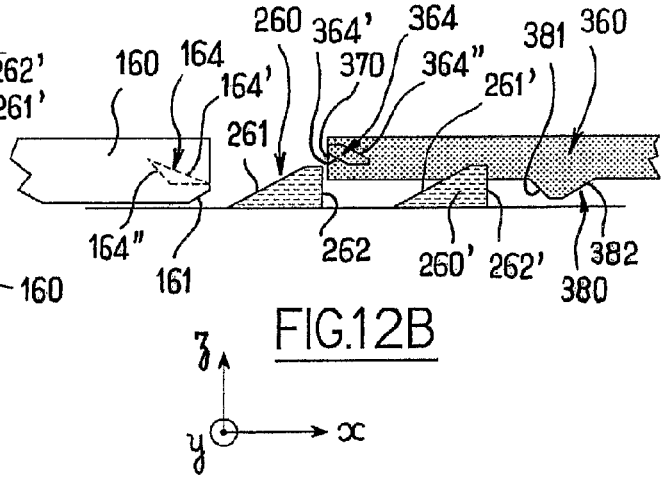

From FIGS. 12A and 12B, the relative positions of these shoulders 260-260' are chosen such that:

The front shoulder 260 of the receptacle 200 can contact the frame shoulder 380 at a determined position of the receptacle 200 with respect to the frame 300. More particularly, at this determined position, the front ramp 261 of the front shoulder 260 can slide on the rear ramp 382 of the frame shoulder 380 when the receptacle 200 is deplaced opposite to the plugging direction, and the back stop wall 262 of the front shoulder 260 can come into abutment onto both the front ramp 381 of the frame shoulder 380 and the end 370 of the frame tongue 360 when the receptacle 200 is deplaced towards the plugging direction. Especially, the height of the front shoulder 260 of the receptacle 200 is chosen such that, when the back stop wall 262 of the front shoulder 260 of the receptacle 200 is stopped by the end part 370 of the frame tongue 360, said back stop wall 262 can go beyond said end part 370 of the frame tongue 360 if the frame tongue 360 is sufficiently deflected into the Z-direction. This deflection can be caused by a pressure exerted by the header tab 164 on the frame tab 364 at their respective front ramps 164'-364' (as foregoing detailed), when these two tabs 164-364 are in contact to each other and the header 100 is in motion along the plugging direction.

The rear shoulder 260' of the receptacle 200 can contact the header ramp 161, at a determined distance separating the receptacle 200 from the header 100. More particularly, at this determined distance, the header ramp 161 and the ramp 161' of the rear shoulder 260' are slidable one onto the other when the header 100 and the receptacle 200 approach one to the other, and the header back stop wall 162 can come into abutment onto the back stop wall 262' of said rear shoulder 260' when the header 100 and the receptacle 200 go away from each other. Especially, the respective positions of these two last back stop walls 162-262' are chosen such that, when they are in contact to each other the plugging between the header 100 and the receptacle 200 is done. Moreover, the height of the rear shoulder 260' of the receptacle 200 is chosen such that, when the header back stop wall 162 is stopped by the back stop wall 262' of the rear shoulder 260', the header back stop wall 163 can go beyond the back stop wall of the rear shoulder 260' if the header tongue 160 is sufficiently deflected into the Z-direction. This deflection can be caused by a pressure exerted by the frame tab 364 on the header tab 164 at their respective rear ramps 364"-164" (as foregoing detailed), when these two tabs 164-364 are in contact to each other and the header 100 is in motion in a direction opposite to the plugging axis.

The purpose of these motions and deflections will be clearly apparent from the following part of the specification.

Figure 7:
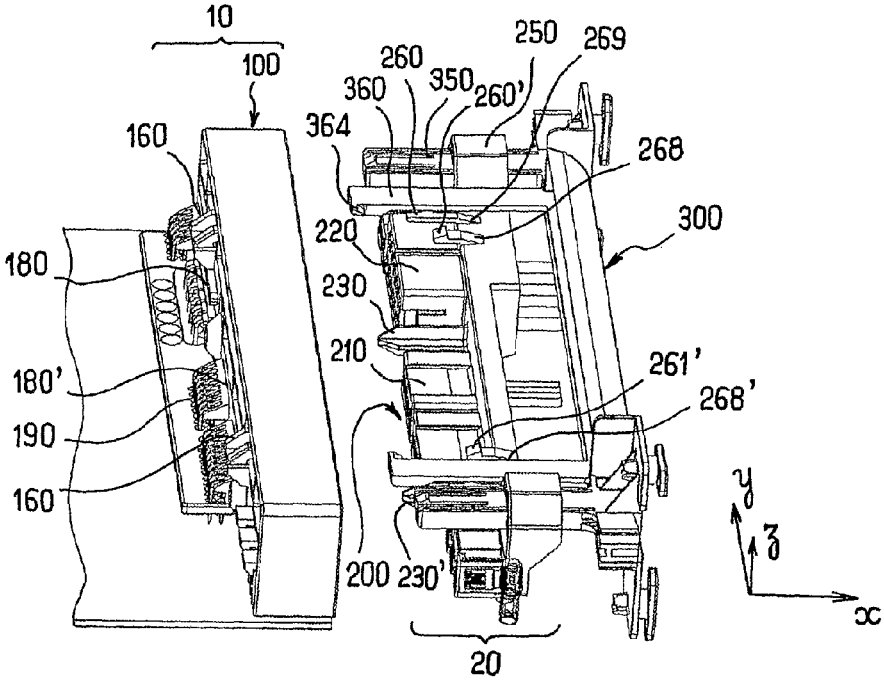
FIGS. 7 and 8 show perspective top views of a connecting system according to the invention.
Figure 8:
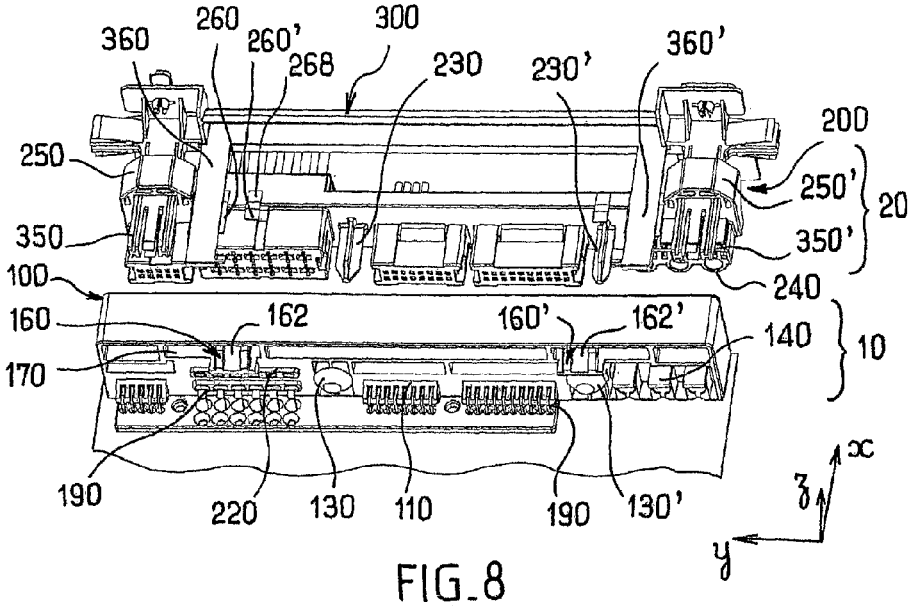
Figure 9A:
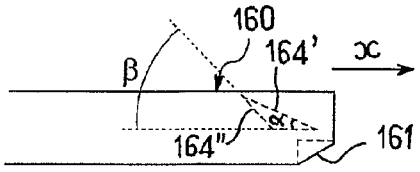
FIGS. 9A and 9B show respectively side and front views of elements of the contact header.
Figure 9B:
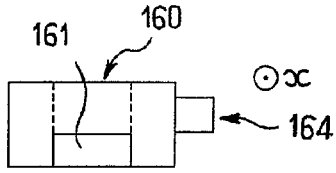

Said shoulders 260-260' of the receptacle 200 can be formed directly on a top surface of the receptacle 200 (see FIGS. 2 and 3), or been attached to the latter by an intermediate piece extending according to a direction generally parallel to the X-axis, like a supporting tongue 268-269 (see for example FIGS. 7 and 8). This second configuration may be especially chosen if the header tongue 160 is housed in a channel 170 (as previously described for a second embodiment of the header 100 according to the invention): Indeed, the supporting tongue 268 of the rear shoulder 260' is necessary in this case for reaching the channel 170 and especially the header ramp 161. Moreover, as the frame tongue 360 has to be longer for reaching the channel 170 such that the frame tab 364 and the header tab 164 contact each other, it may also be necessary to add a supporting tongue 269 under the front shoulder 260 of the receptacle 200 such that it can contact the frame shoulder 380.

Moreover, guiding means 401 are provided on both lateral sides of the support structure extending between the front part 1 and the rear part 2 of the support structure. These guiding means 401 may comprise longitudinal grooves (i.e. grooves parallel to the X-axis) for guiding a corresponding part of the electrical device (not shown). A corresponding part of the device provided on its lateral side can be for example a complementary longitudinal rib, or rollers whose diameters correspond to the width of the grooves. Of course, these longitudinal grooves 401 can alternatively be replaced by longitudinal ribs or rollers for receiving complementary grooves provided on the lateral sides of the electrical device. Other guiding means may be provided.

These guiding means 401 are provided on respective lateral guiding supports, like the internal sides of lateral walls or of lateral girders 400 (as shown in FIGS. 2 and 3), or in any other means adapted for receiving guiding means 401 according to the invention.

Lateral guiding supports 400 can be fixed, at one end, to vertical columns 410-420, themselves respectively fixed to the frame 300.

The frame 300 and the columns 410-420 are preferably two distinct elements in order to allow a parallel movement of the frame 300 relatively to the columns 410-420 for compensating positional tolerances into the (YZ) plane. The lateral guiding supports can thus float or rotate with respect to said (YZ) plane. Centring pins 50 can be provided for ensuring such a (YZ) tolerance. With reference to FIG. 3, each centring pin 50 has a head 52 and a threaded rod 51 to be engaged through an associated crossing hole 331 provided through at a terminal portion of a column 330 of the frame 300 and in an associated hole 411 provided in a terminal portion of an associated said vertical column 410, these holes 331-411 being parallel to the X-axis. The hole 411 is threaded for cooperating with the threaded rod 51 of the centring pin 50, such that the centring pin 50 is screwed within. The frame 300, sandwiched between each head 52 of the centring pins 50 and the columns 410-430, is then fixed to the vertical columns 410-420. However, the holes 331 are provided with a diameter greater than those of the rod 51 of the centring pin 50. A (YZ) tolerance is then defined by the difference of diameter between the rod 51 and the hole 331.

In the following, it will be disclosed a method for mating the electrical device into the support structure.

This method only requires from the operator to push the device into the support structure according to the plugging direction, the forces required to bring changes depending on the stage of the mating. In the following, the values of this force will be indicated by the "E" symbol.

Figure 13A:
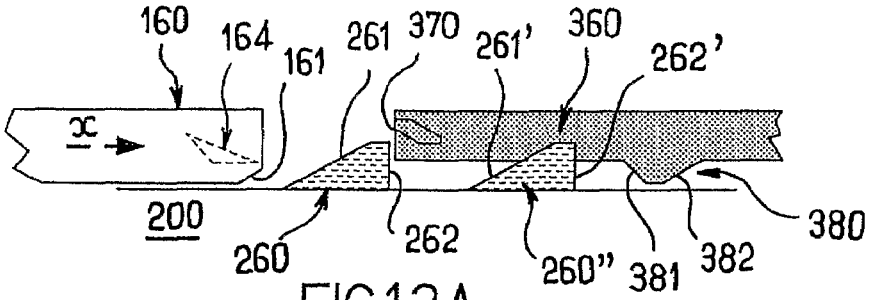
FIGS. 13A to 13E show different side views of said elements, depicting the different steps of mating of the electrical device in the support structure.
Figure 13B:
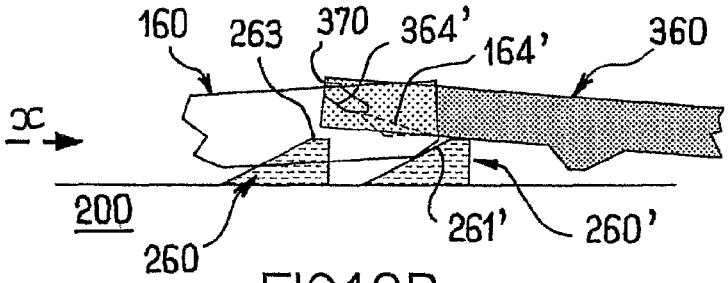
Figure 13C:
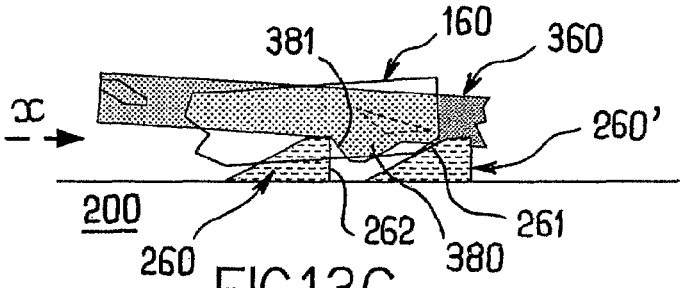
Figure 13D:
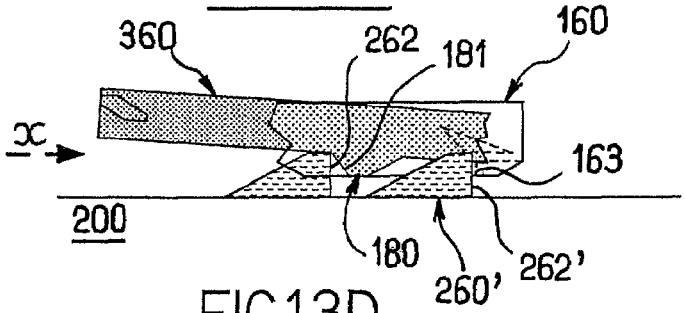
Figure 13E:
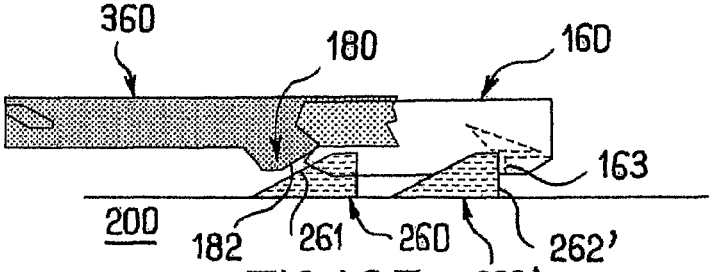

The mating method comprises the following steps:

the introducing of the electrical (or electronic) device into the support structure through the dashboard 500;

a first guiding step of the device along the X-axis towards the rear part 2 of the support structure by sliding the guiding means of the device with the guiding means 401 of the support structure;

a second guiding step of the device towards the receptacle 200 by engaging the centring fingers 230 of the receptacle 200 into the transversal cavities 130 of the header 100 until the header ramp 161 contacts the rear shoulder 260' of the receptacle 200 (FIG. 13A), once the header 100 is stopped at said rear shoulder 260' of the receptacle 200, the receptacle 200 is pushed away (by pushing the header 100 stopped at the rear shoulder 260) until the back stop wall 262 of the front shoulder 260 of the receptacle 200 comes into abutment with the end 370 of the frame tongue 360;

with reference to FIG. 13B, applying a force F1 to the header 100 for allowing the front ramp 164' of the header tab 164 sliding on the front ramp 364' of the frame tab 364, involving a pressure into the Z-direction on the front ramp 364' of the frame tab 364, leading to a deflection of the frame tongue 360 that is sufficient so that the end 370 of the frame tongue 360 is upper than the apex 263 of the front shoulder 260 of the receptacle 200;

as the header 100 is still stopped at the rear shoulder 260' of the receptacle 200, a force exerted on the header 100 involves then the motion of the receptacle 200 such that the front shoulder 260 of the receptacle 200 is moved under the end 370 of the deflected frame tongue 360 towards the plugging direction until the back stop wall 262 of its front shoulder 260 stops onto the front ramp 381 of the frame shoulder 380 (see FIG. 13C); at this stage, the receptacle 200 is at an intermediate position; at the same time, the pressure exerted on the header 100 can be released or kept;

with reference to FIG. 13D, a force F2 is applied to the header 100 such that the header ramp 161 slides on the ramp 261' of the rear shoulder 260' of the receptacle 200 until the rear shoulder 260' is gone beyond; the rear shoulder 260' is then housed in the cavity 262 of the header tongue 160; it is to be noticed that the header 100 is stopped at its header back stop wall 162 by the back stop wall 262' of the rear shoulder 260' if it is pulled away from the support structure; at this stage, the header 100 is then mounted onto the receptacle 200; particularly the connecting elements of the receptacle 200 and of the header 100 cooperates together, and the electrical connection between the device and the external electrical network is thus established; it is also to be noticed that the cooperation between the protruding elements 210-220 of the receptacle 200 and the front cavities 110-120 of the header 100 can help to have a good connection;

with reference to FIG. 13E, as the header 100 is now coupled to the receptacle 200, a sufficient force F3 applied to the header 100 involves the sliding of the receptacle 200, and especially of the back stop wall 262 of the front shoulder 260 of the receptacle 200 onto the front ramp 381 of the frame shoulder 380 until the front shoulder 260 goes beyond the frame shoulder 380; the receptacle 200 is then on a final position; the receptacle 200 (and the header 100 connected to it) is thus mounted to the frame 300; the device is now mounted in the support structure and connected to the external electrical network; the device can thus be powered on and used.

For implementing these steps in this order, it is necessary to have F3>F2>F1.

It is to be noticed that, once the assembly receptacle 200-header 100 is mounted to the frame 300, a degree of freedom according to the X-axis is found by sliding this assembly onto the protrusions 350 of the frame 300.

Accordingly, the position of the device in the support structure can be adjusted along the X-axis.

Especially, the position of the device can be adjusted according to the size of the device and/or of the external housing.

Then, the operator will be able to fix the front part of the device onto the dashboard 500 very precisely and with a degree of freedom in the depth of the housing.

Additionally, the tolerance given in the (YZ) plane (thanks to the connection of the lateral guiding supports 400 to the frame 300), gives to the operator two other degrees of freedom.

The system according to the invention allows then a mating of devices having different dimensions in housings having different dimensions.

In the following, it will be detailed a method for removing the electrical device from the support structure.

This method only requires from the operator to pull away the device from the support structure in a direction opposite to the plugging axis. The mechanical force required for pulling away the device changes depending on the stage of the montage. In the following, the value of this force will be indicated by the "E" symbol.

It is to be noticed that the header 100 and the receptacle 200 are connected together and that these two latter elements are mounted to the frame 300.

Figure 14A:
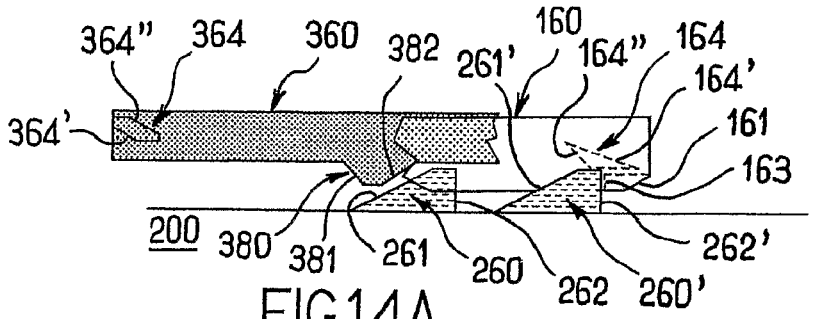
FIGS. 14A to 14E show different side views of said mounting elements depicting the different steps of dismounting of the electrical device from the support structure.
Figure 14B:
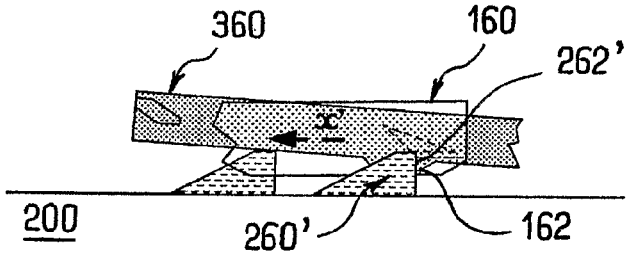
Figure 14C:
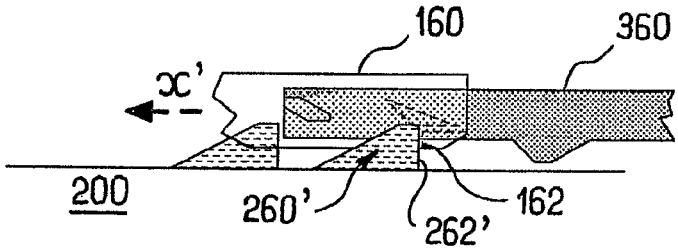
Figure 14D:
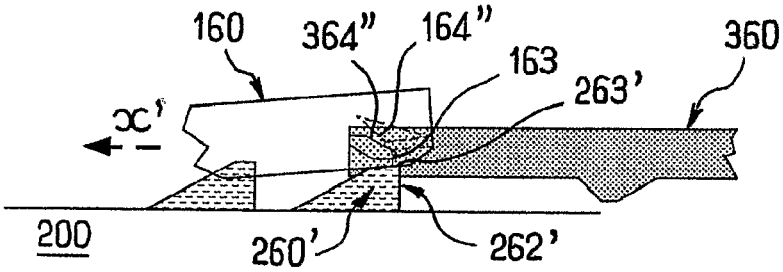
Figure 14E:
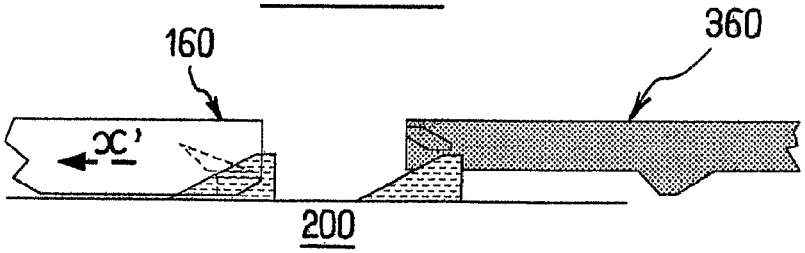

The dismounting method comprises the following steps:

by pulling away the device, with reference to FIG. 14A, the header back stop wall 162 presses the back stop wall 262' of the rear shoulder 260' of the receptacle 200, involving the displacement of the assembly header 100-receptacle 200 (connected together) such that the front ramp 261 of the front shoulder 260 of the receptacle 200 slides onto the rear ramp 382 of the frame shoulder 380 until the front shoulder 260 goes beyond the frame shoulder 380; the receptacle 200 is then at an intermediate position; the receptacle 200 (and the header 100 mounted onto) is then dismounted from the frame 300; the device is now free from the frame 300 but is still connected to the receptacle 200;

pulling away the assembly header 100-receptacle 200 until the header 164 contacts the frame tab 364 (FIGS. 14B-14C);

with reference to FIG. 14D, sliding the rear ramp 164" of the header tab 164 on the rear ramp 364" of the frame tab 364, involving then a pressure into the Z-direction on the rear ramp 164" of the header 164, and leading to a deflection of the header tongue 160 sufficient so that the header back stop wall 162 is higher than the apex 263' of the rear shoulder 260' of the receptacle 200;

by pulling away the header 100, the header 100 goes then beyond the rear shoulder 260' of the receptacle 200 (FIG. 14E); at this stage, the header 100 is then disconnected from the receptacle 200; particularly the connecting elements 112-122-212-222 of the receptacle 200 and of the header 100 are separated, and the electrical connection between the device and the external electrical network is off;

guiding and removing the device from the support structure through the dashboard 500.

The method for disconnecting the electrical device from the support structure requires only to pull away the device according to a direction opposite to the plugging axis, by holding the device from its lateral sides for example.

The invention claimed is:

1. A connecting assembly comprising a frame, a contact receptacle (hereafter "receptacle") of an electrical connector and a contact header (hereafter "header") of a counterpart electrical connector to be plugged into the electrical connector according to a plugging direction, wherein it is arranged such that the header and the receptacle can be both independently pushed into the plugging direction with respect to the frame, and wherein it further comprises:

first stopping means arranged for stopping the header on the receptacle if the header is pushed according to the plugging direction with a force that is lower than a first force limit F2, and for being gone beyond if said force is greater than F2 such that the header and the receptacle are then connected together;

second stopping means arranged for stopping the receptacle on the frame if the receptacle is pushed according to the plugging direction with a force that is lower than a second force limit F3, and for being gone beyond if said second force is greater than F3 such that the receptacle is then mounted to the frame; wherein F3 is greater than F2.

2. A connecting assembly according to claim 1, wherein the frame comprises guiding means for holding and guiding the receptacle according to the plugging direction.

3. A connecting assembly according to claim 1, wherein said guiding means are arranged for leaving to the receptacle a degree of freedom along the plugging axis with respect to the frame, once the header is connected to the receptacle and once the receptacle is mounted to the frame.

4. A connecting assembly according to claim 1, wherein it is further arranged for having a degree of freedom of the header in a plane perpendicular to the plugging axis, with respect to the frame.

5. A connecting assembly according to claim 1, wherein said first stopping means comprises a first ramp borne by the header and a second ramp borne by the receptacle, the first and second ramps being able to slide to each other, wherein the first and second ramps are arranged for being in contact to each other if the header and the receptacle are at a determined distance from each other, and wherein the first ramp is stopped at the second ramp if said first force is lower than F2 and goes beyond said second ramp if said first force is greater than F2.

6. A connecting assembly according to claim 1, wherein said second stopping means comprises a stop wall perpendicular to the plugging axis borne by the receptacle and a third ramp borne by the frame, the stop wall being able to slide onto the third ramp, wherein the stop wall and the third ramp are arranged for being in contact to each other if the receptacle and the frame are at a determined distance from each other, and wherein the stop wall is stopped at the third ramp if said second force is lower than F3 and goes beyond said third ramp if said second force is greater than F3.

7. A connecting assembly according to claim 1, further comprising:

third stopping means arranged for stopping the receptacle to the frame if the receptacle is pushed according to the plugging direction, the third stopping means is located with respect to the second stopping means such that the third stopping means is used before the second stopping means as the receptacle is pushed according to the plugging direction from a remote position;

means for releasing the third stopping means if the header is pushed according to the plugging direction with a third force that is greater than a third force limit F1, such that the receptacle goes beyond the third stopping means.

8. A connecting assembly according to claim 7, wherein said third stopping means comprises a stop wall perpendicular to the plugging axis and provided on a deflectable tongue extending from the frame according to a direction opposite to the plugging direction, and a stop wall perpendicular to the plugging axis and borne by the receptacle, wherein these stop walls are arranged for being in contact to each other if the receptacle and the frame are at a determined distance from each other, and wherein the header comprises means for deflecting the tongue according to a direction perpendicular to the plugging axis such that the tongue is sufficiently deflected from its initial position for removing the abutment between said two stop walls if the header is pushed according to the plugging direction with a force greater than F1; the receptacle, if pushed according to the plugging direction, going then beyond the stop wall of the tongue of the frame until being stopped at the second stopping means.

9. A connecting assembly according to claim 8, wherein the means of the header for deflecting the tongue of the frame comprises a first rigid tab having a front ramp, and wherein the tongue comprises a second rigid tab extending perpendicular to the plugging axis from a side of the tongue and having a front ramp, wherein the header and the frame are arranged such that said ramps are in contact to each other if the header and the frame are at a determined distance from each other and wherein the front ramps of the tabs being able to slide onto the other such that a deflection of the tongue is involved by said sliding if the header is pushed according to the plugging direction.

10. A connecting assembly according to claim 8, wherein the stop wall borne by the frame tongue is the end of the frame tongue.

11. A connecting assembly according to claim 8, wherein the header, the receptacle and the frame are arranged such that the means of the header for deflecting the tongue is used after the header is stopped by the first stopping means if the header is pushed according to the plugging direction, and wherein F2 is greater than F1.

12. A connecting assembly according to claim 8, further comprising fourth stopping means arranged for stopping the receptacle on the frame, once the receptacle is mounted to the frame, if the receptacle is pulled opposite to the plugging direction; the receptacle being then locked onto the frame.

13. A connecting assembly according to claim 12, wherein the fourth stopping means comprises a fourth ramp borne by the receptacle and a fifth ramp borne by the frame, the fourth and fifth ramps being able to slide to each other, wherein the fourth and fifth ramps are arranged for being in contact to each other if the receptacle is mounted onto the frame and if the receptacle and the frame are at a determined distance from each other, and wherein the fourth ramp is stopped at the fifth ramp if said fourth force is lower than F4 and goes beyond said fifth ramp if said fourth force is greater than F4.

14. A connecting assembly according to claim 1, wherein said second stopping means comprises a stop wall perpendicular to the plugging axis borne by the receptacle and a third ramp borne by the frame, the stop wall being able to slide onto the third ramp, wherein the stop wall and the third ramp are arranged for being in contact to each other if the receptacle and the frame are at a determined distance from each other, and wherein the stop wall is stopped at the third ramp if said second force is lower than F3 and goes beyond said third ramp if said second force is greater than F3; wherein the fifth ramp has a sloping angle with respect to the plugging axis that is smaller than the sloping angle of the third ramp.

15. A connecting assembly according to claim 13, further comprising fifth stopping means arranged for preventing the header to be disconnected from the receptacle once the first stopping means has been gone beyond, if the header is pulled opposite to the plugging direction; the header being then locked onto the receptacle.

16. A connecting assembly according to claim 15, wherein the fifth stopping means comprises:

a stop wall provided on the receptacle and extending perpendicular to the plugging axis; —a stop wall provided on the header and extending perpendicular to the plugging axis; and wherein the respective positions of these two stop walls are chosen for allowing them to face each other if the header is connected to the receptacle and if the header is pulled opposite to the plugging direction.

17. A connecting assembly according to claim 15, further comprising means for releasing the fifth stopping means if the header connected to the receptacle is pulled opposite to the plugging direction, with a fifth force that is greater than a fifth force limit F5, such that the header goes beyond the fifth stopping means for being then disconnected from the receptacle.

18. A connecting assembly according to claim 16, wherein the stop wall provided on the header is on a deflectable tongue extending to the plugging direction from the header, and wherein the means for releasing the fifth stopping means comprises means for deflecting the tongue according to a direction perpendicular to the plugging direction such that the tongue is sufficiently deflected from its initial position for having its stop wall upper than the apex of the stop wall provided on the receptacle, if the header is pulled opposite to the plugging direction with a force greater than F5; the header, if pulled opposite to the plugging direction, going then beyond the stop wall of the receptacle; the header and the receptacle being then disconnected to each other.

19. A connecting assembly according to claim 18, wherein the means for deflecting the tongue of the header comprises a third rigid tab extending perpendicular to the plugging axis and having a rear ramp provided on the frame, and wherein the tongue of the header comprises a fourth rigid tab having a rear ramp and extending perpendicular to the plugging axis from a side of the tongue, the rear ramps of the tabs being able to slide onto the other such that a deflection of the header tongue is involved by said sliding if the header is pulled opposite to the plugging direction, wherein the header and the frame are arranged such that said ramps are in contact to each other if the header and the frame are at a determined distance from each other.

20. A connecting assembly according to claim 19 wherein the means of the header for deflecting the tongue of the frame comprises a first rigid tab having a front ramp, and wherein the tongue comprises a second rigid tab extending perpendicular to the plugging axis from a side of the tongue and having a front ramp, wherein the header and the frame are arranged such that said ramps are in contact to each other if the header and the frame are at a determined distance from each other and wherein the front ramps of the tabs being able to slide onto the other such that a deflection of the tongue is involved by said sliding if the header is pushed according to the plugging direction; wherein the second rigid tab extending from a side of the tongue of the frame and the third rigid tab extending from a side of the tongue of the header, and wherein the first and fourth rigid tabs of the header are a single tab and the second and third tabs of the frame are a single tab.

21. A connecting assembly according to claim 20, wherein the header is intended to be fixed to the back side of an electrical or electronic device, and wherein the assembly comprises means for guiding this device according to the plugging axis.

22. A connecting assembly according to claim 21, wherein it is designed for being housed in an external cavity and for housing the device and connecting the latter to an external electrical network via said connectors.

23. A method for connecting on a frame a contact receptacle (hereafter "receptacle") of an electrical connector and a contact header (hereafter "header") of a counterpart electrical connector to be plugged into the electrical connector according to a plugging direction, characterized in that the receptacle and the header are both mobile towards the plugging direction with respect to the frame, in that the method comprises the following steps:

(a) mounting the receptacle on the frame at an intermediate position;

(b) locking the header to the receptacle such that the electrical connector and the counterpart electrical connector are plugged together;

(c) subsequently locking the receptacle on the frame at a final position; and in that these different steps are implemented by exerting a force to the header according to the plugging direction.

24. A method according to claim 23, characterized in that the force necessary for implementing successively the steps (a), (b) and (c) respectively increases.

25. A method for disconnecting from a frame a contact receptacle (hereafter "receptacle") of an electrical connector and a contact header (hereafter "header") of a counterpart electrical connector having been plugged to the electrical connector according to a plugging direction, characterized in that the receptacle and the header are both able to be mobile in a direction opposite to the plugging direction with respect to the frame, in that the method comprises the following steps:

(c) dismounting the receptacle connected to the header from the frame;

(d) dismounting the header from the receptacle so as to disconnect the electrical connector and the counterpart electrical connector, the header having then no contact with both the receptacle and the frame; and in that these different steps are implemented by exerting a force on the header opposite to the plugging direction.

26. A connector assembly for receiving and connecting an electrical device to an external electrical network according to a plugging axis, comprising:

a housing for housing the electrical device, comprising: a front aperture for engaging the electrical device into the housing along the plugging axis; lateral guiding means for guiding the electrical device from the front aperture to a rear part of the housing according to the plugging axis; a fixed frame at a rear part of the housing structure, comprising second guiding means according to the plugging axis; an electrical connector for receiving the external electrical network from a rear side and a counterpart electrical connector on a front side, the electrical connector being mounted to said second guiding means, being then mobile along the plugging axis, wherein the electrical connector comprising a contact receptacle (hereafter called "receptacle");

a counterpart electrical connector for being plugged into the electrical connector according to the plugging axis, the counterpart electrical connector being further intended to be mounted at a back side of said electrical device and electrically connected to the latter, wherein it comprises a contact header (hereafter "header") arranged for cooperating with said receptacle for allowing said plug;

first stopping means arranged for stopping the header on the receptacle if the header is pushed in the housing according to the plugging axis with a force that is lower than a first force limit F2, and for being gone beyond if said force is greater than F2 such that the header is then locked to the receptacle and that said connectors are plugged together;

second stopping means arranged for stopping the receptacle to the frame if the receptacle is pushed in the housing according to the plugging axis with a force that is lower than a second force limit F3, and for being gone beyond if said second force is greater than F3 such that the receptacle is then mounted to the frame; wherein F3 is greater than F2.

27. A connector assembly according to claim 26, wherein said second guiding means are arranged for leaving to the receptacle a degree of freedom along the plugging axis with respect to the frame once the header is connected to the receptacle and once the receptacle is mounted to the frame.

28. A connector assembly according to claim 26, wherein the lateral guiding means are mounted to the frame such that it can be slightly moved in a plane perpendicular to the plugging axis, with respect to the frame.

29. A connector assembly according to claim 26, wherein the header comprises a first tongue extending according to the plugging axis and deflectable according to an axis perpendicular to the plugging axis, the first tongue comprising a front ramp at its end part, and wherein the receptacle comprises a first shoulder with a front ramp, the front ramps being able to slide to each other if the header and the receptacle are moved towards each other and if the header and the receptacle are at a determined distance from each other, these ramps being said first stopping means.

30. A connector assembly according to claim 29, wherein the first tongue further comprises a back stop wall behind the front ramp and perpendicular to the plugging axis, and wherein the first shoulder of the receptacle comprises a back stop wall perpendicular to the plugging axis, such that, when the front ramps have slid to each other if the header and the receptacle are moved towards each other, the two back stop walls can be in contact to each other, locking the header to the receptacle.

31. A connector assembly according to claim 30, wherein the frame comprises a second tongue extending according to the plugging axis and deflectable according to an axis perpendicular to the plugging axis, the second tongue comprising a shoulder with a front ramp, and wherein the receptacle comprises a second shoulder with a back stop wall perpendicular to the plugging axis, the front ramp of the second tongue and the back stop wall of the second shoulder being able to slide to each other if the receptacle is pushed towards the frame and if the frame and the receptacle are at a determined distance from each other, these front ramp and back stop wall being said second stopping means.

32. A connector assembly according to claim 31, wherein the shoulder of the second tongue further comprises a rear ramp, and wherein the second shoulder of the receptacle further comprises a front ramp, such that, when the back stop wall of the first shoulder have slid to the front ramp of the second tongue if the receptacle is moved towards the frame, the front ramp of the first shoulder can be in contact with the rear ramp of the second tongue, locking the receptacle to the frame.

33. A connector assembly according to claim 32, wherein the front ramp has a sloping angle greater than the rear ramp of the shoulder of the second tongue.

34. A connector assembly according to claim 26, further comprising third stopping means arranged for stopping the receptacle to the frame if the receptacle is pushed towards the frame, the third stopping means being located with respect to the second stopping means such that the third stopping means is used before the second stopping means as the receptacle is pushed from a remote position; and wherein the header comprises means for releasing the third stopping means if the header is pushed towards the frame with a third force that is greater than a third force limit F1, such that the receptacle goes beyond the third stopping means.

35. A connector assembly according to claim 34 wherein the header comprises a first tongue extending according to the plugging axis and deflectable according to an axis perpendicular to the plugging axis, the first tongue comprising a front ramp at its end part, and wherein the receptacle comprises a first shoulder with a front ramp, the front ramps being able to slide to each other if the header and the receptacle are moved towards each other and if the header and the receptacle are at a determined distance from each other, these ramps being said first stopping means; wherein the frame comprises a second tongue extending according to the plugging axis and deflectable according to an axis perpendicular to the plugging axis, the second tongue comprising a shoulder with a front ramp, and wherein the receptacle comprises a second shoulder with a back stop wall perpendicular to the plugging axis, the front ramp of the second tongue and the back stop wall of the second shoulder being able to slide to each other if the receptacle is pushed towards the frame and if the frame and the receptacle are at a determined distance from each other, these front ramp and back stop wall being said second stopping means; wherein said third stopping means comprises: a stop wall perpendicular to the plugging axis and provided on the second deflectable tongue and the back stop wall of the second shoulder, wherein these stop walls are arranged for being in contact to each other if the receptacle and the frame are at a determined distance from each other and if the receptacle is pushed towards the frame, and wherein the first tongue comprises means for deflecting the second tongue according to a direction perpendicular to the plugging axis such that the second tongue is sufficiently deflected from its initial position for releasing the abutment between said two stop walls if the header is pushed towards the frame with a force greater than F1; the receptacle, if pushed then towards the frame, being able to go beyond the stop wall of the frame until being stopped at the second stopping means.

36. A connector assembly according to claim 35, wherein the means for deflecting the second tongue comprises a first rigid tab, and wherein the second tongue comprises a second rigid tab, the first and second rigid tabs extending perpendicularly to the plugging axis and both having a front ramp, wherein the header and the frame are arranged such that said front ramps are in contact to each other if the header and the frame are at a determined distance from each other, and wherein the front ramps of the tabs being able to slide onto the other such that said deflection of the second tongue is involved by said sliding if the header is pushed towards the frame.

37. A connector assembly according to claim 35, wherein the stop wall of the second tongue is the end of the second tongue.

38. A connector assembly according to claim 35, wherein the header, the receptacle and the frame are arranged such that the means of the first tongue for deflecting the second tongue is used after the header is stopped by the first stopping means if the header is pushed towards the frame, and wherein F2 is greater than F1.

39. A connector assembly according to claim 30 wherein the frame comprises a second tongue extending according to the plugging axis and deflectable according to an axis perpendicular to the plugging axis, the second tongue comprising a shoulder with a front ramp, and wherein the receptacle comprises a second shoulder with a back stop wall perpendicular to the plugging axis, the front ramp of the second tongue and the back stop wall of the second shoulder being able to slide to each other if the receptacle is pushed towards the frame and if the frame and the receptacle are at a determined distance from each other, these front ramp and back stop wall being said second stopping means; wherein the second tongue comprises means for deflecting the first tongue according to a direction perpendicular to the plugging axis in order to release the abutment between the back stop wall of the first tongue and the back stop wall of the first shoulder of the receptacle, this abutment being found when the header is connected to the receptacle and if the header is pulled opposite to the receptacle.

40. A connector assembly according to claim 39, wherein the first tongue comprises a first rigid tab, and wherein the means for deflecting the first tongue comprises a second rigid tab, the first and second rigid tabs extending perpendicularly to the plugging axis and both having a rear ramp, wherein the header and the frame are arranged such that said rear ramps are in contact to each other if the header and the frame are at a determined distance from each other, and wherein the rear ramps of the tabs being able to slide onto the other such that said deflection of the first tongue is involved by said sliding if the header is pulled outwards the frame.

41. A connector assembly according to claim 36 wherein the first tongue comprises a first rigid tab, and wherein the means for deflecting the first tongue comprises a second rigid tab, the first and second rigid tabs extending perpendicularly to the plugging axis and both having a rear ramp, wherein the header and the frame are arranged such that said rear ramps are in contact to each other if the header and the frame are at a determined distance from each other, and wherein the rear ramps of the tabs being able to slide onto the other such that said deflection of the first tongue is involved by said sliding if the header is pulled outwards the frame; wherein said first rigid tabs of the second tongue are a single rigid tab, and said second rigid tabs of the first tongue are a single rigid tab.

* * * * *